US011459155B2

(12) United States Patent
Weyrauch

(10) Patent No.: US 11,459,155 B2
(45) Date of Patent: Oct. 4, 2022

(54) PALLET CONTAINER WITH DRAINAGE TUBE

(71) Applicant: MAUSER-WERKE GMBH, Bruehl (DE)

(72) Inventor: Detlev Weyrauch, Kreuzau-Untermaubach (DE)

(73) Assignee: MAUSER-WERKE GMBH, Bruehl (DE)

( * ) Notice: Subject to any disclaimer, the term of this patent is extended or adjusted under 35 U.S.C. 154(b) by 0 days.

(21) Appl. No.: 17/273,572

(22) PCT Filed: Sep. 18, 2019

(86) PCT No.: PCT/EP2019/000271
§ 371 (c)(1),
(2) Date: Mar. 4, 2021

(87) PCT Pub. No.: WO2020/057772
PCT Pub. Date: Mar. 26, 2020

(65) Prior Publication Data

US 2021/0237957 A1 Aug. 5, 2021

(30) Foreign Application Priority Data

Sep. 19, 2018 (DE) ..... 202018004352.4

(51) Int. Cl.
*B65D 77/06* (2006.01)
*B65D 77/04* (2006.01)

(52) U.S. Cl.
CPC ..... *B65D 77/061* (2013.01); *B65D 77/0466* (2013.01)

(58) Field of Classification Search
CPC .... B65D 19/00; B65D 77/04; B65D 77/0466; B65D 77/06; B65D 77/061
(Continued)

(56) References Cited

U.S. PATENT DOCUMENTS 6,719,162 B2 * 4/2004 Przytulla ..... B65D 19/44 206/386
7,108,133 B2 * 9/2006 Przytulla ..... B65D 77/0466 206/386
(Continued)

FOREIGN PATENT DOCUMENTS

EP 2090528 A1 8/2009
WO WO-9324389 A2 12/1993
(Continued)

OTHER PUBLICATIONS

International Search Report and Written Opinion for International Application No. PCT/EP2019/000271, dated Nov. 27, 2019.

*Primary Examiner* — Bryon P Gehman
(74) *Attorney, Agent, or Firm* — Marshall, Gerstein & Borun LLP

(57) ABSTRACT

A pallet container for storage and for transportation of liquid or free-flowing contents has a thin-walled, rigid plastic inner container composed of thermoplastic material, having a tubular lattice frame, which, in the form of a supporting jacket, tightly encloses the plastic inner container and which is composed of horizontal and vertical tubular bars which are welded to one another, and having a rectangular bottom pallet, on which the plastic inner container bears and to which the tubular lattice frame is firmly connected.

17 Claims, 6 Drawing Sheets

(58) Field of Classification Search
USPC ..... 206/386; 220/9.1–9.4
See application file for complete search history.

(56) References Cited

U.S. PATENT DOCUMENTS

| | | | | |
|---|---|---|---|---|
| 7,648,040 | B2 * | 1/2010 | Przytulla | B65D 77/0466 206/386 |
| 10,961,035 | B2 * | 3/2021 | Weyrauch | B65D 77/0466 |
| 10,994,911 | B2 * | 5/2021 | Weyrauch | B65D 77/068 |
| 11,124,343 | B2 * | 9/2021 | Weyrauch | B65D 77/068 |
| 2007/0053617 | A1 | 3/2007 | Naidu et al. | |
| 2016/0001951 | A1 * | 1/2016 | Siebel | B65D 85/70 206/386 |
| 2020/0290789 | A1 * | 9/2020 | Weyrauch | B65D 11/20 |

FOREIGN PATENT DOCUMENTS

| | | | | |
|---|---|---|---|---|
| WO | WO-2008028556 | A1 * | 3/2008 | B65D 77/0466 |
| WO | WO-2016124267 | A1 | 8/2016 | |

* cited by examiner

PALLET CONTAINER WITH DRAINAGE TUBE

CROSS-REFERENCE TO RELATED APPLICATIONS

This is the United States national phase of International Patent Application No. PCT/EP2019/000271, filed Sep. 18, 2019, which claims priority to German Patent Application No. DE 202018004352.4, filed Sep. 19, 2018, the entire contents of each of which are hereby incorporated herein by reference.

FIELD OF THE DISCLOSURE

The invention relates to a pallet container for storage and for transportation of liquid or free-flowing contents, having a thin-walled, rigid inner container composed of thermoplastic material, having a tubular lattice frame, which, in the form of a supporting jacket, tightly encloses the plastic inner container and which is composed of horizontal and vertical tubular bars which are welded to one another, and having a rectangular bottom pallet, on which the plastic inner container bears and to which the tubular lattice frame is firmly connected, wherein the rectangle-shaped plastic inner container has a bottom-side extraction connector with an extraction fitting which can be closed off, and wherein a flexible inliner composed of plastic film is inserted into the rigid plastic inner container and, at the bottom, is connected in a gas- and liquid-tight manner to the extraction connector, and/or to the extraction fitting, of the rigid plastic inner container via an inliner connector.

BACKGROUND

Pallet containers (also referred to as "IBCs" below) are used extensively in the chemical industry, predominantly for transport of liquid chemicals. These chemical products are for the most part classified as hazardous liquid contents because, in concentrated form, they are hazardous to the health of humans and animals and hazardous to the environment. During storage and transportation in IBCs, the chemicals can adversely affect, for example stain, contaminate or damage, the HDPE material of the plastic inner container in such a way that the used plastic inner containers cannot be simply washed and re-used. In the case of a usual multiple use of used pallet containers, the only option that remains is replacement of the damaged plastic inner container with a new inner container. Considering that a plastic inner container can weigh approximately 14 kg to 18 kg according to the requirements profile, this however constitutes a costly solution with a not inconsiderable waste of plastic material. Another, less expensive solution is to protect the plastic inner container against contamination by the respective contents by means of an inserted thin inliner or film bag and, in this way, to make possible multiple re-use of the plastic inner container. It is then necessary only to dispose of the contaminated inliner and to insert a new inliner for further use of the pallet container.

The insertion of thin-walled film bags or inliners into rigid cuboidal outer containers, such as for example large, rigid cardboard boxes or cartons (so-called bag in box), is a measure which has been customary for years. For this purpose, simple cylindrical, cubic or pillow-like inliners are available for square-shaped or rectangle-shaped outer containers. Said inliners can be used without any problems for open containers having an externally positioned extraction system. However, various problems arise for pallet containers having a rigid plastic inner container with an upper access opening and a lower extraction opening. Said problems occur both with the insertion and connection of the film inliner and with the extraction of the liquid contents, because, at the end of the extraction process, it is frequently the case that the collapsing inliner closes off the extraction opening at the inner side so that large residual quantities remain in the pallet container.

The use of a thin film-type inliner in a rigid plastic inner container of a conventional pallet container is known from the document EP 2 090 528 A1. What is involved here is inter alia the secure fixing of the thin-walled inliner extraction connector to the rigid extraction connector of the plastic inner container with the aid of the screwed-on extraction fitting. The front edge of the thin film tube is in this case firmly clamped on the rigid extraction connector on the face side by the housing screw nut of the extraction fitting. The fixing and securing against rotation of the inliner extraction connector is realized here only by clamping, following full tightening of the housing screw nut.

The publication WO 2016/124267 A1 describes an inliner having an adapter and having an extraction fitting connected thereto for a pallet container for bottom filling and bottom extraction, the enclosed region of which is sealed off in an air-tight manner with respect to the surroundings. In this case, the inliner is connected at the inner side to the disk- or pot-shaped adapter, and the adapter is fastened from the outside to the extraction connector of the plastic inner container by means of a union threaded ring. The extraction fitting, in turn, is fastened at the outer side to the adapter pot. A disadvantage here is that gas- and liquid-tight sealing and fixing are necessary both for the adapter pot on the extraction connector of the plastic inner container and for the extraction fitting on the outer side of the adapter pot. In the known pallet container, the inliner is in the form of a film tube which is open on one side. The introduction of the unstable film tube inliner through the lower extraction connector of the plastic inner container could well cause some problems. Moreover, at the end of the emptying process, the film tube will inevitably block the opening in the extraction connector of the plastic inner container, with the result that large residual quantities of contents remain in the pallet container. If the intention is for pallet containers provided in such a manner with an inliner that have a changed sealing system through interposition of an adapter disk to be provided for use in the transportation of hazardous goods, a new approval test with a new approval number is required for said pallet containers.

Practice has shown that customers do not like it, and reject further use of thin-walled inliners in pallet containers, if hindrances frequently occur here during the extraction of the residual contents owing to formation of creases in the inliner, as a result of which the inner connection of the extraction fitting becomes blocked.

GENERAL DESCRIPTION

The present invention is based on the object of a pallet container intended exclusively for—preferably aseptic—bottom filling and bottom extraction of liquid contents being provided with an inliner in such a way that no changes to the conventional sealing system have to be made, such as for example additional sealing, so that no new approval test for the use of hazardous liquid contents is required. It is also the intention that upgrading, by means of a single-layer or multi-layer inliner with a diffusion barrier, of used—possibly even stained—plastic inner containers of re-used pallet containers for re-use for high-quality contents is made possible. The intention is for the insertion of the inliner to be simplified to such an extent that the process can in principle be carried out by anyone. It is furthermore intended that the residual quantities of contents remaining in the inliner after an extraction process are reduced to a minimum.

Said object is achieved by the particular features of patent claim 1. The features in the independent claims describe further advantageous possible configurations of the pallet container according to the invention. The proposed technical teaching according to the present invention is that the inliner connector of the inliner is directly connected in a materially bonded manner, specifically is welded, to the on the cylindrical tube connector, facing toward the inner side of the plastic inner container, of the extraction fitting housing of the extraction fitting. The inliner and the extraction fitting consequently constitute a closed unit, which is preferably provided for aseptic bottom filling. As a result of the welding of the inliner connector directly to the extractor fitting housing, no changes to the existing, conventional sealing system are made, and so no new approval test is required for the use of hazardous liquid contents.

In an advantageous configuration, it is provided that the inliner connector is, via a cylindrical welding region, directly welded radially from the inside to the inner surface of the cylindrical tube connector of the extraction fitting housing. This renders unnecessary interposed connecting elements such as adapter disks or the like.

For the purpose of realizing this configuration, it is provided in a very unconventional manner that the inliner connector is, by means of a pin-like welding device introduced from the outer side of the extraction fitting into the extraction fitting housing, welded onto the inner surface of the cylindrical tube connector of the extraction fitting housing.

In another variant, the inliner connector is, by means of a pin-like welding device introduced from the inner side of the inliner into the extraction fitting housing, welded onto the inner surface of the cylindrical tube connector of the extraction fitting housing.

In this way, with any additional adapter components (such as for example flange sleeves or the like) being dispensed with, no change or extension to the sealing chain is caused, specifically neither in the outer region of the plastic inner container nor in the inner inliner system. As a result of the inner-side, direct, materially bonded connection of the inliner and the housing of the extraction fitting, the outer covering relevant for approval by BAM (Bundesamt für Materialprüfung—Federal Institute for Materials Testing) is not changed and it is consequently possible for the approvals for hazardous goods for the numerous pallet container embodiments to be used with the utilization of the inliner according to the invention too, without a new approval test.

In an expedient configuration of the invention, it is provided that a drainage tube is firmly inserted at the inner side into the extraction fitting housing of the extraction fitting and projects some way through the inliner connector into the inliner. As a result, during the extraction of the residual contents, the collapsing inliner is prevented from being able to be placed in front of the inner opening of the extraction fitting in a manner causing a hindrance.

In a particularly preferred configuration of the invention, it is provided that the extraction fitting is in the form of a 3" extraction fitting (3-inch extraction fitting), and, for the insertion or for the fixing of the drainage tube, a base disk is inserted into the extraction fitting housing of the extraction fitting. Since the drainage tube has a diameter which is smaller than (that is to say approximately only half as large as) the diameter of the extraction fitting housing of the 3-inch extraction fitting, use is made of a broken-through base disk for the purpose of fixing said drainage tube. Close to its outer edge, the base disk has an off-center bore in which the drainage tube is inserted and fixed. The apertures in the base disk serve for large and unhindered liquid throughflow during filling and emptying of the plastic inner container.

The drainage tube is expediently integrated directly into the base disk, and the two are produced as a one-part component in an injection-molding process. In this way, unwanted detachment of the drainage tube from the base disk is impossible and excluded.

In an advantageous configuration of the pallet container according to the invention, the inliner, which is welded directly onto the extraction fitting, is in the form of a simple rectangle-shaped pillow liner, wherein those corners of the inliner film which face toward the extraction fitting are folded in to the center, and the inliner film is rolled up from both sides to the center to form a relatively rigid, bar-like film roll and is covered by a tubular packing cover. In this way, the inliner, rolled up to form a bar-like shape, can be easily introduced through the bottom-side extraction connector of the rigid plastic inner container into the interior of the latter.

The tubular packing cover expediently consists of a thin plastic film and is provided with a separating line which extends in a longitudinal direction and which can be easily torn open. In this way, during the filling of the plastic inner container through the bottom-side extraction connector, owing to the filling pressure of the inflowing liquid contents, the separating line, which can be easily torn open, of the tubular packing cover bursts open and the rolled-up inliner film can unroll laterally and be unfolded without hindrance.

According to this structurally innovative configuration, the extraction fitting with welded-on inliner, with drainage tube, inserted therein, with base disk, and with packing cover pulled thereover is formed as an easily exchangeable module unit which unfolds automatically during filling and which, in principle, can be fitted very easily by anyone and so as to be ready for use into a clean plastic inner container of a pallet container.

A method for producing a module unit consisting of an extraction fitting with welded-on inliner, with drainage tube, inserted therein, with base disk, and with packing cover pulled thereover, which module unit serves for being inserted into a pallet container, is characterized by the following method steps:

- introducing the inliner connector into that part of the cylindrical tube connector of the extraction fitting housing of the extraction fitting which faces toward the plastic inner container,
- introducing a pin-like welding device into the inliner connector from the inner side of the inliner or from the outer side of the extraction fitting housing,
- welding the inliner connector radially from the inside to the inner surface of the cylindrical tube connector of the extraction fitting housing by means of the pin-like welding device,
- removing the pin-like welding device and, if appropriate, welding shut the still open bottom seam of the inliner,
- folding and rolling up the inliner to form a bar-like film roll, and
- pulling a tubular, thin-walled packing cover over the rolled-up inliner.

In this way, which is simple in terms of manufacture, a module unit described above can be easily produced and prepared for insertion into the plastic inner container of a new or used pallet container without any changes being made to the conventional sealing system. Consequently, in a use for hazardous goods contents, no new approval test is required.

BRIEF DESCRIPTION OF THE DRAWINGS

The invention will be explained and described in more detail below on the basis of an exemplary embodiment illustrated schematically in the drawings, in which.

DETAILED DESCRIPTION

Figure 1:
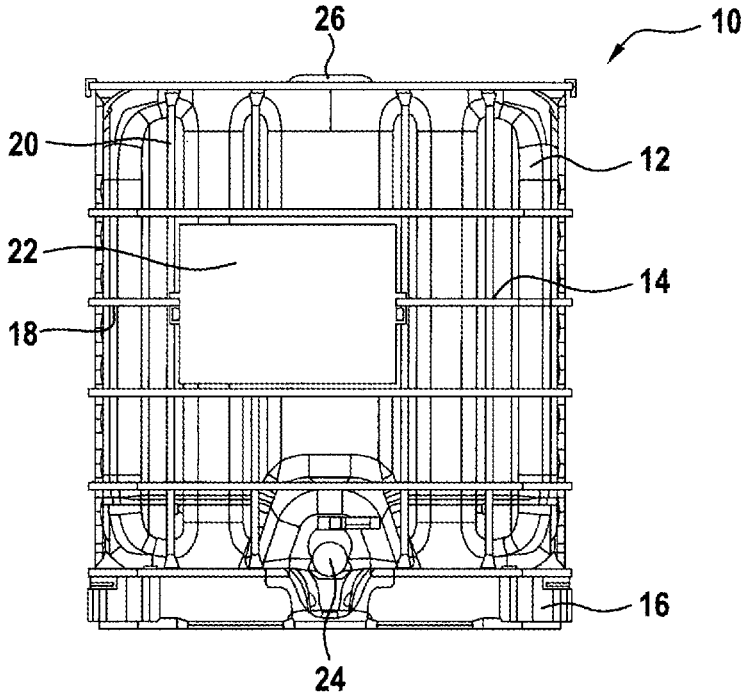
FIG. 1 shows, in a front view, an IBC according to the invention with an inserted inliner.

In FIG. 1, the reference sign 10 denotes a pallet container according to the invention for storage and for transportation of in particular hazardous liquid or free-flowing contents. For use with hazardous contents, the pallet container 10 meets particular test criteria and is provided with corresponding official approval. The main components of the pallet container 10 consist of a thin-walled, rigid plastic inner container 12, which is produced from thermoplastic material in a blow-molding process, a tubular lattice frame 14, which, in the form of a supporting jacket, tightly encloses the plastic inner container 12, and a bottom pallet 16, on which the plastic inner container 12 bears and to which the tubular lattice frame 14 is firmly connected. The outer tubular lattice frame 14 consists of horizontal and vertical tubular bars 18, 20 which are welded to one another.

The bottom pallet 16, in the version illustrated, is in the form of a composite pallet having an upper steel-sheet carrying plate, having a tubular steel carrying frame arranged therebelow and having plastic corner and center feet. It would however also be possible for any other conventional bottom pallet composed of wood, steel or plastic to be built at the bottom.

A label panel 22 composed of a thin steel sheet for identification of the respective contents is attached to the front side of the tubular lattice frame 14. In the top, the plastic inner container 12 has a relatively large container opening with a diameter of 150 mm or 225 mm, said container opening being closable by means of a screw cover 26. For extraction of the liquid content, a corresponding extraction fitting 24 is connected centrally to the lower edge of the front wall of the plastic inner container 12 in a protected position in a set-back wall recess.

In order to protect the rigid plastic inner container 12 from direct contact with the contents introduced and from non-detachable adhering material thereof, and to allow multiple re-use of the valuable plastic inner container 12, prior to each new filling of the pallet container 10, a thin-walled, flexible inliner 28 or, according to an earlier description, a film bag is inserted into the rigid plastic inner container 12, this being connected at the bottom to the extraction connector of the rigid plastic inner container 12 or to the extraction fitting 24. Sensitive contents are often transported and stored in a closed system, with exclusion of air and without admission of oxygen, in containers with a diffusion barrier (aroma protection) or under aseptic conditions. Filling and extraction are realized here exclusively via the filling and extraction fitting at the bottom side. Since the blow-molded plastic inner containers, consisting of HD-PE (high-density polyethylene), of the large-volume pallet containers generally exhibit only very poor diffusion barrier properties or are completely lacking in this regard, for high-grade sensitive contents, multi-layer inliners with good diffusion barrier properties are generally used and inserted into the rigid blow-molded plastic inner containers.

In the present exemplary embodiment, the plastic inner container 12 of the pallet container 10 is equipped in the bottom-side extraction region with a 3" extraction connector with external thread (DN 80 coarse thread). A 3" extraction fitting 24 with integrated threaded flange 36 (DN 80 coarse thread) is firmly screwed onto said extraction connector.

Figure 2:
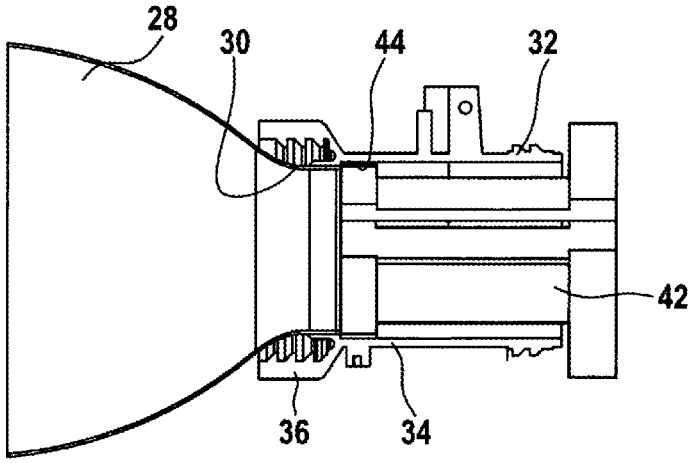
FIG. 2 shows, in a cross-sectional illustration, a 3-inch extraction fitting with an inserted welding device for welding in the flexible inliner connector.

The 3" extraction fitting 24, which is illustrated in more detail in FIG. 2, is in the form of a DN 80 extraction fitting with flat valve and DN 100/DN 80 coarse thread, is produced from polyethylene (PE) and exhibits high resistance with respect to many types of liquids. On the front side, for the purpose of protection against soiling and damage, the 3" extraction fitting 24 is closed off by a screw cap of the DN 80 coarse thread type that is screwed onto the cylindrical extraction fitting housing 32. Approximately in the center of the cylindrical extraction fitting housing 32, a disk-shaped rotary flap (not visible here) is arranged on a rotary shaft 38 with an upper handle 40.

For the purpose of explaining the process-related production sequence for welding on the flexible inliner connector 30, as a demonstration, a pin-like welding device 42 with a cylindrical welding region 44 is pushed into the cylindrical extraction fitting housing 32, the disk-like rotary flap and the rotary shaft 38 with handle 40 being removed for this purpose.

In FIG. 2, it can be seen that the inliner connector 30 of the inliner 28, according to the present invention, is welded directly on the cylindrical tube connector 34 of the extraction fitting housing 32 of the extraction fitting 24. In this case, the inliner connector 30 is, via a cylindrical welding region 44, welded radially from the inside directly onto the inner surface of that side of the cylindrical tube connector 34 of the extraction fitting housing 32 which faces toward the inner side of the plastic inner container 12. As a special feature in terms of manufacture, the inliner connector 30 is, by means of a pin-like welding device 42 introduced from the outer side of the extraction fitting 24 into the extraction fitting housing 32, welded onto the inner surface of the cylindrical tube connector 34 of the extraction fitting housing 32.

At the front side, the welding device 42 is equipped with an expandable welding head which presses the plastic film of the inliner connector 30 in the intended welding region 44 on the inner surface of the cylindrical tube connector 34 of the extraction fitting housing 32 with a predefinable pressure and predefinable application of heat over a specific period of time, and welds said plastic film to the tube connector in a materially bonded manner. After the welding process, surplus film material of the inliner connector 30 is cut off directly behind the welding region 44.

Another possibility for welding the inliner connector 30 into the extraction fitting housing 32 is, in terms of manufacture, that the inliner connector 30 is, by means of the pin-like welding device 42 introduced from the inner side of the inliner 28, welded to the inner surface of the cylindrical tube connector 34 of the extraction fitting housing 32. Here, the pillow liner 28 is still open on its rear side when delivered since the welding device 42 is introduced from the inside through the film bag, which is still open on the rear side, into the inliner connector 30 or into the cylindrical tube connector 34 of the extraction fitting housing 32. Only after this process step of welding in the inliner connector is the bottom seam of the pillow liner 28 welded shut and tightly closed.

Figure 3:
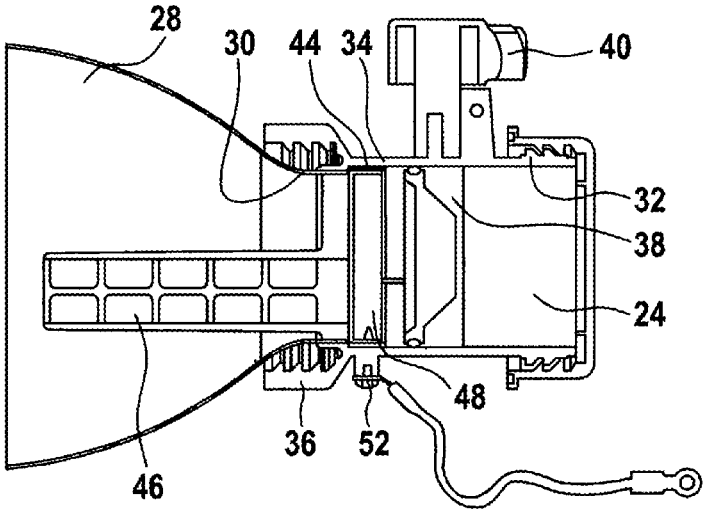
FIG. 3 shows, in a cross-sectional illustration, the 3-inch extraction fitting fully assembled with a fully welded-in inliner connector.

After completion of the welding process for the inliner connector 30 at the 3-inch extraction fitting 24, a drainage tube 46 is inserted into the inliner 28 or into the extraction fitting housing 32 by means of a base disk 48. Afterwards, a grounding cable is screwed onto the extraction fitting housing 32 by way of a grounding screw 52, and the rotary shaft 38, with disk-like rotary flap and handle 40, is re-installed. Finally, the extraction fitting housing 32 is closed off in a gas- and liquid-tight manner by a screw cap screwed on at the outer side. FIG. 3 illustrates the fully assembled filling and extraction fitting 24 with welded-in inliner connector 30.

Figure 4:
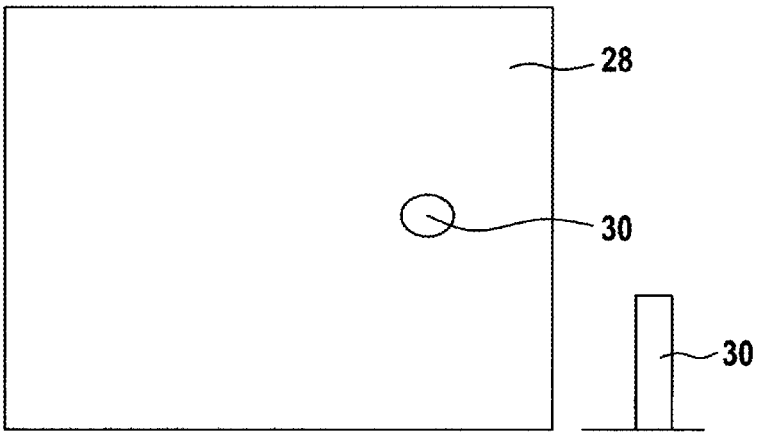
FIG. 4 shows, in plan view, an inliner in the form of a rectangular pillow liner.

As can be seen in FIG. 4, the thin-walled flexible inliner 28, in a preferred embodiment, is in the form of a simple rectangle-shaped pillow liner 28 and produced from a tubular film with a large diameter, while the bottom-side, flexible inliner connector 30 is produced from a tubular film with a small diameter, wherein both of these always consist of the same multi-layer composite film material with the same barrier properties; this excludes disadvantageous plastic material-penetrating diffusion processes. In the present case, the inliner 28 and the inliner connector 30 consist of a transparent LDPE film with a film thickness of 100 μm. The film thickness, in particular in the case of multi-layer films with a diffusion barrier, may also be between 100 μm and 250 μm, preferably approximately 150 μm. The dimensions for example for a 1000 l pallet container are approximately 2140×2200 mm. The inliner connector 30 is welded centrally into the inliner 28 at a distance of approximately 490 mm from the boundary. Here, the cut length of the inliner connector 30 should be approximately 250 mm and the diameter should be approximately 90 mm.

Figure 5:
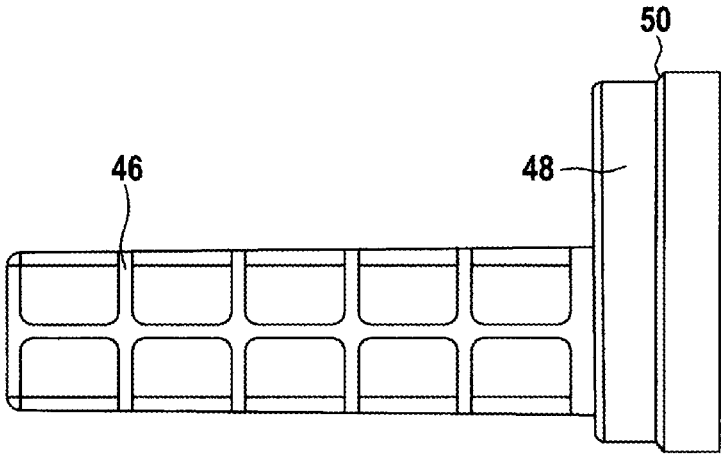
FIG. 5 shows, in a side view, a drainage tube with a base disk.
Figure 6:
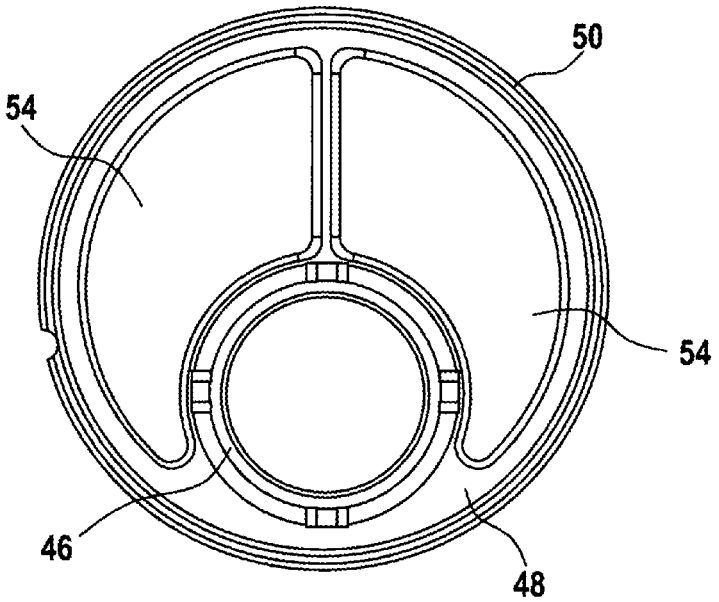
FIG. 6 shows a front view of the drainage tube with base disk.
Figure 7:
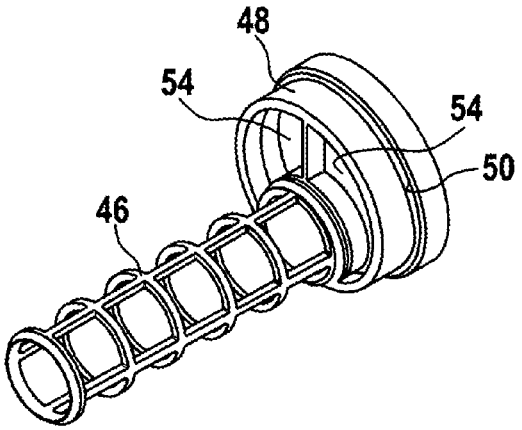
FIG. 7 shows a perspective view of the drainage tube with base disk.

The drainage tube 46, with open lattice structure, and the base disk 48 are illustrated in FIG. 5. The drainage tube 46 is a stable, flexurally rigid grid tube with numerous apertures, which make it possible for the residual liquid to flow away in an optimum manner. For a diameter of approximately 45 mm, the length of the drainage tube 46 should be at least 250 mm. As can be seen in FIG. 6, the base disk 48 has a large bore for the drainage tube and has at least two further large apertures 54 for an unhindered throughflow of liquid. FIG. 7 shows the base disk 48 and the drainage tube 46 once again in a perspective view. At the outer side, the base disk 48 is provided with a set of graduated diameter steps 50 (larger than the inner-side diameter step) and, together with the drainage tube 46, is pushed from the outflow side of the extraction fitting 24 up to a stop at a corresponding set of graduated diameter steps at the inner end of the inner-side tube connector 34 and into the extraction fitting housing 32.

After the base disk 48, with the drainage tube 46, has been placed at the lowest position, the base disk 48 is fixed in a rotationally secured manner by means of a grounding screw 52 screwed in from the outside. The position of the base disk 48 is thus secured against rotation or slipping in the extraction fitting housing 32 by way of the grounding screw 52.

The illustrated standard 3-inch (CCS 100×8) extraction fitting 24 is equipped with a grounding cable connection provided for the EX antistatic designs, wherein the electrical connection to the liquid contents is established by way of the screwed-in grounding screw 52. After all the components have been connected to one another, the rotary shaft 38 with sealing flap and handle 40 are re-inserted into the extraction fitting 24 and the extraction fitting housing 32 is closed off by a screw cap screwed on at the outer side.

Figure 8:
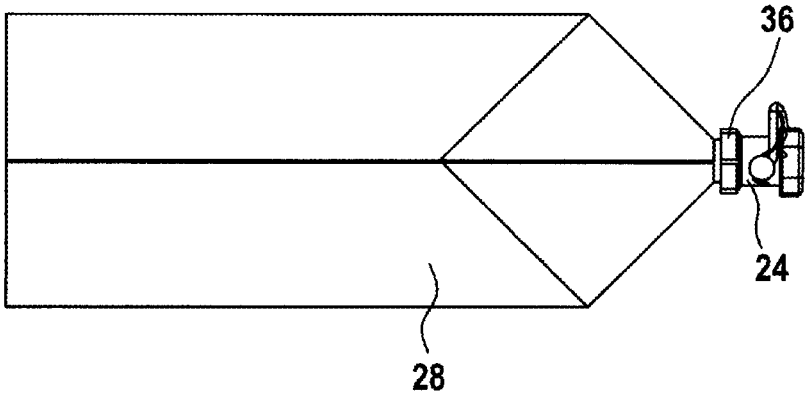
FIG. 8 shows a plan view of the half-folded-in pillow liner with extraction fitting.

Subsequently, the pillow liner 28 is firstly folded, then rolled up and finally picked (packed into a cover). FIG. 8 shows the pillow liner 28 in the semi-finished folded-in state. For the purpose of folding together the pillow liner 28, any air is forced out of the inliner. For complete de-aeration, a negative-pressure hose may be connected to the extraction fitting 24 and a vacuum may be applied. This considerably simplifies the folding, rolling and picking. The completion of the process in which the pillow liner 28 forms with the extraction fitting 24 a module unit 58 that is simple to handle comprises the following steps:

1st step: laying out the finished pillow liner and folding down the upper region to a point transverse to the extraction fitting, 2nd step: folding in the upper corners at the extraction fitting to the center of the pillow liner, 3rd step: folding in the lower region up to the horizontal center of the pillow liner, 4th step: folding in the outer wings up to the vertical center, 5th step: folding in the outer wings up to the vertical center again, 6th step: rolling up the outer edges up to the center, 7th step: pulling a tubular packing cover onto the rolled-up inliner.

Figure 9:
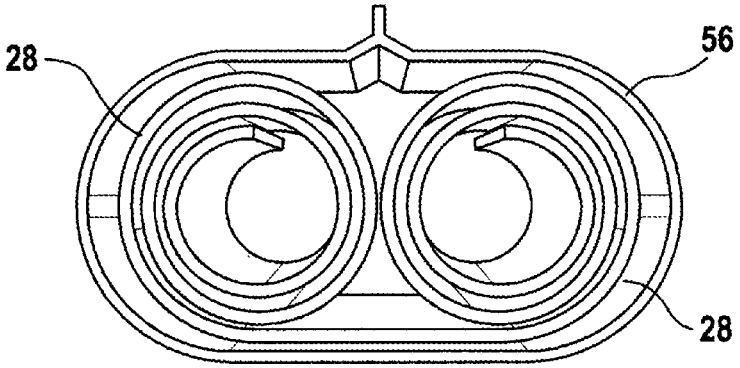
FIG. 9 shows a schematic cross-sectional illustration through the rolled-up pillow liner with mounted packing cover.

FIG. 9 shows, in a purely schematic illustration, a cross section through the rolled-up inliner 28 with tubular packing cover 56. The packing cover 56 has, indicated at the top, a separating seam, or perforated bursting seam, which can be easily torn open.

Figure 10:
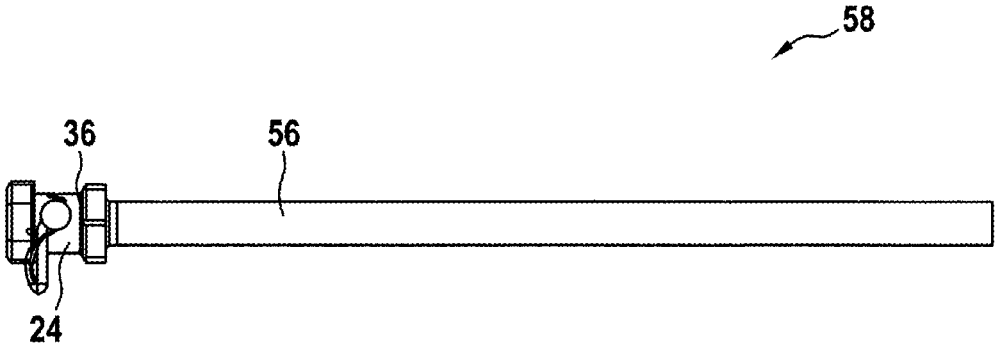
FIG. 10 shows an inliner/extraction fitting module unit for which picking has been completed.

The extraction fitting 24 with directly welded-on and rolled-up inliner 28 and with pulled-on tubular packing cover 56 constitutes an exchangeable module unit 58 and is ready for use in any plastic inner container of a pallet container. Such an inliner extraction fitting module unit 58 for which picking has been completed is illustrated in FIG. 10. For warehousing and for protection of the packing cover 56, which can be easily torn open, the prepared module units 58 may in each case be inserted into a thin-walled protective tube, for example a metal sleeve or a cardboard tube, which can be screwed into the threaded flange of the extraction fitting housing.

Figure 11:
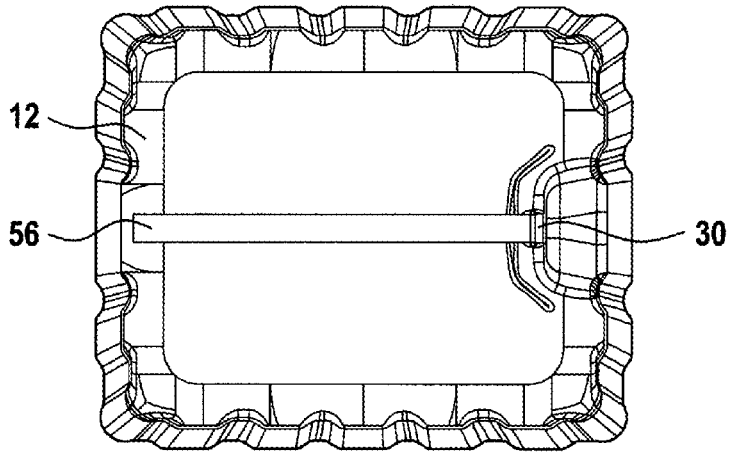
FIG. 11 shows the inliner/extraction fitting module unit in the pushed-in state in the plastic inner container with fitted packing cover.

For the purpose of equipping a pallet container 10 with a module unit 58, the tubular packing cover 56 is inserted through the bottom-side extraction connector and into the plastic inner container 12. The inner diameter of the 3-inch extraction connector is 83.2 mm. The tubular packing cover 56 of the rolled-up pillow liner 28 has a diameter of 75 mm. The introduction of the tubular pack and screwing of the extraction fitting housing onto the 3-inch extraction connector can therefore be carried out in a correspondingly simple manner. A module unit 58 inserted into the plastic inner container 12 in such a manner is shown in FIG. 11.

There are furthermore embodiments of pallet containers in which the bottom-side extraction connector of the plastic inner container is not in the form of a screw connector with external thread but in the form of a short tube connector with weld flange. Accordingly, the associated extraction fittings are also provided with a container-side weld flange and, according to requirement, are welded onto the extraction connector of the plastic inner container according to the hot plate-welding (butt-welding) process. In realizing the present invention for container embodiments of said type, it may be provided that the inliner connector 30 is, in a simple manner by means of a matched annular welding device, welded from the outside via a cylindrical welding region onto the outer surface of the cylindrical tube connector 34 of the extraction fitting housing 32, and only after insertion of the inliner into the plastic inner container is the extraction fitting, provided with the inliner, welded by way of its weld flange onto the corresponding weld flange on the lower rigid extraction connector of the plastic inner container.

Figure 12:
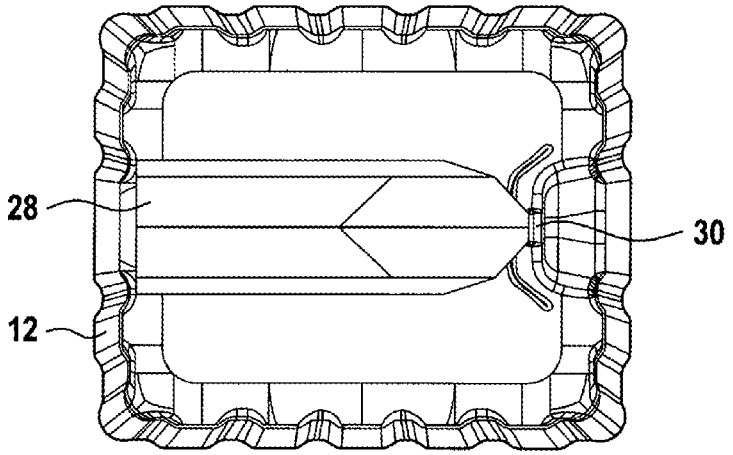
FIG. 12 shows the inserted inliner/extraction fitting module unit with open packing cover in the unrolled partial state prior to complete unfolding.

The filling and emptying of the pallet container 10 takes place exclusively via the bottom-side 3-inch extraction fitting 24 of the plastic inner container 12. During the filling, the contents are normally guided into the container under pressure, such that, after the packing cover 56 is torn open along a, for example perforated, bursting seam, the pillow liner 28 is firstly completely unrolled, unfolded and finally lifted until it has attained its entire volume. For this purpose, FIG. 12 illustrates the state, when filling begins, in which the packing cover 56 has opened and the inliner 28 is unrolled on both sides.

When emptying, the pillow liner 28 collapses and retains a residual volume of approximately 5 liters. Here, the drainage tube 46 prevents the inliner film from blocking the outlet and a relatively large quantity of contents from remaining in the plastic inner container 12.

With the aid of a corresponding connection (separate or in an upper filling cover), the plastic inner container 12 can be subjected to pressure so as to force further contents out of the pillow liner 28. Here, a pressure as low as 0.1 bar is sufficient. The positive pressure results in further residual liquid being forced out of the inliner 28, with a small residual amount of approximately 0.5 liters (approximately 0.05%) remaining. In order to bring about this promotion and improvement of the emptying of residual material from the inliner 28, there is arranged, for connecting a compressed-air pump, a corresponding container opening at a suitable position in the top of the plastic inner container 12. Preferably, the container opening is designed centrally in the upper screw cover 26 of the filling opening of the plastic inner container 12 as a 2-inch bung opening, which can be closed off in a gas- and liquid-tight manner by a 2-inch bung plug.

Replacement of a Used Pillow Liner 28:

After the contents have been completely extracted, the pillow liner 28 can be removed from the plastic inner container 12. For this purpose, the pallet container 10 is expediently tipped on its "back", so that the extraction fitting 24 points upward. The tightly closed extraction fitting 24 is unscrewed from the rigid extraction connector and, with the welded-on inliner nozzle 30 and the pillow liner 28, is pulled out from the extraction connector of the plastic inner container 12 up to a point slightly behind the drainage tube 46. Directly behind the drainage tube 46, the pillow liner 28 is, for example using a cable tie or binding wire, squeezed off and closed off in a drip-tight manner. The extraction fitting 24 and pillow liner 28 are then separated from one another. The pillow liner 28, by means of a gripper, is removed through the large filler neck in the top of the plastic inner container 12, that is to say pulled out laterally in this case. The pillow liner 28 and extraction fitting 24 are subsequently passed on to a recycling process and, following possibly required external cleaning of the pallet container 10, a new inliner/extraction fitting module unit 58 can be inserted into the plastic inner container 12 and the pallet container 10 is prepared again for inexpensive re-use for renewed filling with liquid contents.

The use of the module unit 58 according to the invention with the extraction fitting 24 and inliner 28 welded directly to one another makes it possible to protect the value of high-quality plastic inner containers 12 which are usable multiple times.

The insertion of the module unit 58 and the inliner 28 is so simple that anyone can carry out the process.

Since for the module unit 58 according to the invention, no changes to the existing sealing system are made, no new approval tests are required for use with hazardous liquid contents. Upgrading of already used—possibly even stained—plastic inner containers of re-used pallet containers for re-use for high-quality contents is made possible. Furthermore, the residual quantities of contents remaining in the inliner 28 can be reduced to a minimum with the aid of a drainage tube 46 and through application of a small positive pressure in the plastic inner container 12 during the emptying process for the pallet container 10.

The present invention consequently offers the customer a correctly functioning solution for protection from adhering material of residual contents in the plastic inner container in the case of new pallet containers and with multiple re-use of used IBCs.

The invention claimed is:

1. A pallet container (10) for storage and for transportation of liquid or free-flowing contents, the pallet container comprising:

a thin-walled, rigid plastic inner container (12) composed of thermoplastic material;

a tubular lattice frame (14), which, in the form of a supporting jacket, tightly encloses the plastic inner container (12) and which is composed of horizontal and vertical tubular bars (18, 20) which are welded to one another; and a rectangular bottom pallet (16), on which the plastic inner container (12) bears and to which the tubular lattice frame (14) is firmly connected, wherein the rigid plastic inner container (12) has an upper filler neck, which can be closed off by means of a screw cover (26), and a bottom-side extraction connector, with an extraction fitting (24) which can be closed off, and wherein a flexible inliner (28) composed of plastic film is inserted into the rigid plastic inner container (12) and, at the bottom, is connected in a gas-tight and liquid-tight manner to at least one of the extraction connector and the extraction fitting (24) of the rigid plastic inner container (12) via an inliner connector (30), wherein the inliner connector (30) of the inliner (28) is directly connected in a materially bonded manner to a cylindrical tube connector (34) of an extraction fitting housing (32) of the extraction fitting (24) and facing toward an inner side of the rigid plastic inner container (12), and wherein a drainage tube (46) is firmly inserted into the cylindrical tube connector (34) of the extraction fitting housing (32) of the extraction fitting (24).

2. The pallet container as claimed in claim 1, wherein the inliner connector (30) is, via a cylindrical welding region (44), directly connected in a materially bonded manner radially from an inside to an inner surface of the cylindrical tube connector (34) of the extraction fitting housing (32).

3. The pallet container as claimed in claim 1, wherein the inliner connector (30) of the inliner (28) is welded directly onto the cylindrical tube connector (34), facing toward the inner side of the rigid plastic inner container (12), of the extraction fitting housing (32) of the extraction fitting (24).

4. The pallet container as claimed in claim 1, wherein the inliner connector (30) is, by means of a welding device introduced from an outer side of the extraction fitting (24) into the extraction fitting housing (32), welded onto an inner surface of the cylindrical tube connector (34) of the extraction fitting housing (32).

5. The pallet container as claimed in claim 1, wherein the inliner connector (30) is, by means of a welding device introduced from an inner side of the inliner into the extraction fitting housing (32), welded onto an inner surface of the cylindrical tube connector (34) of the extraction fitting housing (32).

6. The pallet container as claimed in claim 1, wherein the drainage tube (46) projects some way through the welded-in inliner connector (30) into the inliner (28).

7. The pallet container as claimed in claim 6, wherein the extraction fitting (24) comprises a 3-inch extraction fitting, and, for the insertion of the drainage tube (46), a base disk (48) is inserted into the cylindrical tube connector (34) of the extraction fitting housing (32) of the extraction fitting (24).

8. The pallet container as claimed in claim 7, wherein the drainage tube (46) and the base disk (48) are produced as a one-part component in an injection-molding process.

9. The pallet container in claim 7, wherein the base disk (48) is fixed in a rotationally fixed manner in the extraction fitting (24) by means of a metallic grounding screw (52) screwed in through the cylindrical tube connector (34) of the extraction fitting housing (32).

10. The pallet container as claimed in claim 7, wherein the inliner (28), which is welded directly onto the extraction fitting (24), comprises a simple rectangle-shaped pillow liner, and corners of the plastic film of the flexible inliner (28) which face toward the extraction fitting (24) folded in to a center, and is rolled up from both sides to the center to form a bar-like film roll and is covered by a tubular packing cover (56).

11. The pallet container as claimed in claim 10, wherein the tubular packing cover (56) consists of a thin plastic film and is provided with a separating line which extends in a longitudinal direction and which can be easily torn open.

12. The pallet container as claimed in claim 10, wherein the extraction fitting (24) with welded-on inliner (28), with drainage tube (46), inserted therein, with base disk (48), and with packing cover (56) pulled thereover comprises an easily exchangeable module unit (58) which unfolds automatically during filling.

13. The pallet container as claimed in claim 1, wherein the inliner connector (30) is produced as a tubular film with a small diameter and the flexible inliner (28) comprises a tubular film with a large diameter, the inliner connector and flexible inliner being constructed from a same multi-layer composite film material with same barrier properties.

14. The pallet container as claimed in claim 1, wherein arranged in the screw cover (26) at the closeable container opening in the top of the plastic inner container (12) is a bung opening which can be closed off by means of a 2-inch or ¾-inch bung plug and which serves for connection of a compressed-air pump.

15. The pallet container as claimed in claim 1, wherein the flexible inliner connector (30) of the inliner (28) is welded from an outside via a cylindrical welding region onto [an outer surface of the cylindrical tube connector (34) of the extraction fitting housing (32) by means of a matched annular welding device, wherein only after insertion of the inliner into the plastic inner container is the extraction fitting, provided with the inliner, welded by way of a weld flange of the extraction fitting onto a corresponding weld flange on a lower rigid extraction connector of the plastic inner container.

16. A method for producing a module unit consisting of an extraction fitting with welded-on inliner, with drainage tube, inserted therein, with base disk, and with packing cover pulled thereover, which module unit serves for being inserted into a pallet container as claimed in claim 1, the method comprising:

introducing the inliner connector into a part of the cylindrical tube connector of the extraction fitting housing of the extraction fitting which faces toward the plastic inner container, introducing a pin-like welding device into the inliner connector from an inner side of the inliner, welding the inliner connector radially from an inside to an inner surface of the cylindrical tube connector of the extraction fitting housing by means of the pin-like welding device, removing the pin-like welding device and welding shut a still open bottom seam in the inliner, folding and rolling up the inliner to form a bar-like film roll, and pulling a tubular, thin-walled packing cover over the rolled-up inliner.

17. A method for producing a module unit consisting of an extraction fitting with welded-on inliner, with drainage tube, inserted therein, with base disk, and with packing cover pulled thereover, which module unit serves for being inserted into a pallet container as claimed in claim 1, the method comprising:

introducing the inliner connector through the extraction fitting housing and externally turning the inliner connector inside out over an outer extraction fitting housing of the extraction fitting, introducing a pin-like welding device from an outside through the extraction fitting housing and the inliner connector, welding the inliner connector radially from an inside to an inner surface of the cylindrical tube connector of the extraction fitting housing by means of the pin-like welding device, removing the pin-like welding device and trimming away an excess length of the inliner connector, folding and rolling up the inliner to form a bar-like film roll, and pulling a tubular, thin-walled packing cover over the rolled-up inliner.

* * * * *